US006500045B1

(12) United States Patent
Secrist

(10) Patent No.: US 6,500,045 B1
(45) Date of Patent: Dec. 31, 2002

(54) ARTIFICIAL BLANK AND EYE

(76) Inventor: Pat Robert Secrist, 1519 S. Badour Rd., Midland, MI (US) 48640

( * ) Notice: Subject to any disclaimer, the term of this patent is extended or adjusted under 35 U.S.C. 154(b) by 0 days.

(21) Appl. No.: 09/841,278

(22) Filed: Apr. 24, 2001

(51) Int. Cl.[7] ..... A63H 3/38

(52) U.S. Cl. ..... 446/389; 446/392; 434/296; 428/16

(58) Field of Search ..... 434/295, 296; 446/389, 392, 343; 428/16

(56) References Cited

U.S. PATENT DOCUMENTS

| | | | | | |
|---|---|---|---|---|---|
| 4,477,500 | A | * | 10/1984 | Powell | 428/16 |
| 4,639,235 | A | * | 1/1987 | Ibe | 428/16 |
| 5,087,204 | A | * | 2/1992 | Thompson | 434/271 |
| 5,735,895 | A | | 4/1998 | Rinehart | |
| 6,007,881 | A | * | 12/1999 | Lennard | 156/57 |
| 6,099,379 | A | * | 8/2000 | Eppley | 446/389 |

* cited by examiner

*Primary Examiner*—Jacob K. Ackun

(57) ABSTRACT

What is disclosed herein is an artificial eye blank comprised of a transparent artificial eyepiece segment and a moveable artificial nictitating membrane which is slidably mounted on the bottom outside circumferential edge of the artificial eyepiece segment.

28 Claims, 1 Drawing Sheet

ARTIFICIAL BLANK AND EYE

This invention deals with artificial eyes and blanks from which such eyes are manufactured. Artificial eyes are used in manufacturing toys, taxidermy work, and other varied uses, the most prevalent use of artificial eyes being for stuffed toy animals, baby dolls, and for taxidermy work.

BACKGROUND OF THE INVENTION

Taxidermists mount animal head skins over molded animal head manikins, such as deer head manikins. The manikins are usually manufactured from dense foamed materials and are configured for the particular animal being mounted by the taxidermist. Thus, the manikins have nose openings, eye sockets, and the like and the taxidermist must: supply the materials and means by which these openings are rendered realistic.

For eye sockets, the taxidermist uses artificial eyes and mounts the eyes using modeling clay or other anatomy contouring materials. The taxidermist must be skilled in that, the eyes must be mounted with regard to natural appearance, which means that with deer eyes there must be a nictitating membrane present on the eye, and the nictitating membrane must be in the proper orientation.

A nictitating membrane is the thin membrane found in many animals at the inner angle or beneath the lower lid of the eye and capable of extending across the eyeball. To enhance the realism of a mounted animal head, it is preferable that the artificial eye, such as the artificial deer eye, include a feature corresponding to the nictitating membrane found in the live animal. Nictitating membrane features for artificial deer eyes have previously been implemented using thin black strips, usually formed from plastic in the crescent shape of a natural nictitating membrane. The nictitating membrane piece is mounted by the taxidermist, along with the artificial deer eye itself, into the animal head manikin. The positioning and securing of the artificial eye and the nictitating membrane piece in the correct anatomical position in the animal head manikin demands considerable time and skill of the taxidermist.

In one prior art approach to supplying nictitating membranes for artificial eyes, U.S. Pat. No. 5,735,895, issued on Apr. 7, 1998 to John Rinehart, discloses that such nictitating membranes can be colored into the artificial eye blank, by using glass glazes and the like.

Yet another approach to providing nictitating membranes for artificial eyes is to mold the nictitating membrane into the artificial eye blank when the blank itself is molded.

Thus, the processes set forth in the prior art result in artificial eyes having nictitating membranes that are permanently affixed to the artificial eye blank. Taxidermists using such artificial eyes still have to deal with the problem of the proper orientation of the artificial eye during the taxidermy of the animal head.

The present invention overcomes such problems, along with other related problems in the use of artificial eyes that include nictitating membranes.

DETAILED DESCRIPTION OF THE INVENTION

Thus, what is disclosed herein is an. transparent eye blank comprising a transparent artificial eyepiece blank having a concave inner surface and a convex outer surface and an outside circumferential edge. There is also present, a moveable artificial nictitating membrane formed of a colored material, the nictitating membrane being slidably mounted on the artificial eye blank over a portion of the bottom edge of the transparent artificial eyepiece blank.

Figure 1:
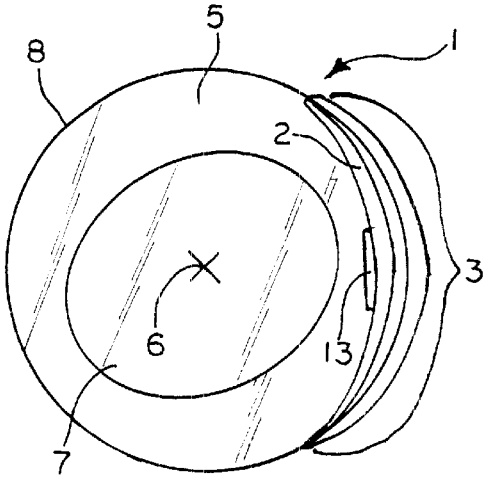
FIG. 1 is a full top view of the eye blank of this invention containing a clip-on nictitating membrane of this invention.

Now, with more specificity, and with reference to FIG. 1, this invention deals with a transparent artificial eyepiece blank I having a novel moveable artificial nictitating membrane 2, wherein there is shown a full top view of the eye blank 1 of this invention wherein there is shown a transparent artificial eyepiece blank I having a concave inner surface 4 (See FIG. 2) and a convex outer surface 5, to form a hyperbolic or semispherical configuration.

Figure 2:
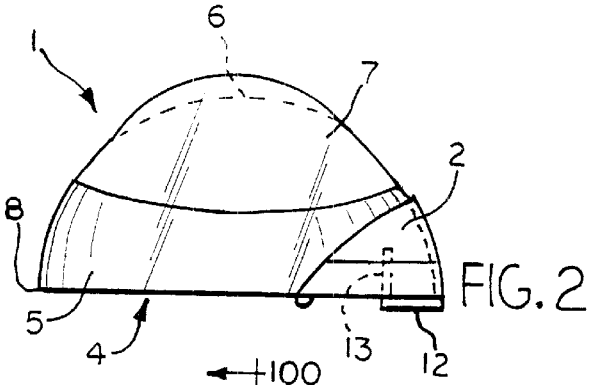
FIG. 2 is a full side view of the eye blank of this invention containing a clip-on nictitating membrane of this invention.

Integrally surmounted on the apex 6 (the center point located at X) of the convex outer surface 5 is an artificial lens 7 (See also FIG. 2) . The transparent artificial eyepiece blank 1 has an outside circumferential edge 8, a portion 3 of which is covered with the nictitating membrane 2.

Figure 3:
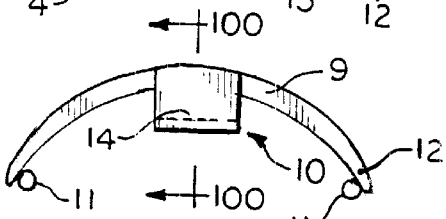
FIG. 3 is a full bottom view of the clip-on nictitating membrane on the eye blank shown in FIGS. 1 and 2.

The nictitating membrane 2 is configured of two parts, which are integrally molded together to form the nictitating membrane 2. The two parts, which are shown in FIG. 3, which is a full bottom view of the nictitating membrane 2, are the articificial membrane shield 9 formed in the shape of a crescent, and a flexible or spring-like clip 10. Further shown in FIG. 3 is a set of small tabs 11, on each end of the shield 9, which are extensions of the ends of the shield 9. These tabs 11 are on the bottom edge 12 of the shield 9 and are used to stabilize the shield 9 when it is in place over the convex surface 5 of the transparent artificial eyepiece blank 1.

The clip 10 is configured such that it slips over the circumferential edge 8 of the transparent artificial eyepiece blank 1, and by this means, the crescent shape of the nictitating membrane 2 covers a portion 3 of the bottom edge of the eye blank 1. Moreover, because the clip 10 is flexible, or spring-like in nature, the post 13 of the clip 10, (see FIG. 2, wherein the post 13 of the clip 10 is shown in place in phantom behind the circumferential edge 8) rests lightly against the concave inner surface 4. Because of this configuration, the nictitating membrane 2 can be slid around the circumferential edge 8 of the eye blank 1, and thus be placed anywhere along such circumferential edge 8 when the eye blank 1 is mounted in place in the manikin of the deer head.

In place, the circumferential edge 8 of the eye blank 1 slips into the slot 14 of the clip 10, which slot 14 is created by post 13, and the support member 15 that carries and supports the post 13.

Figure 6:
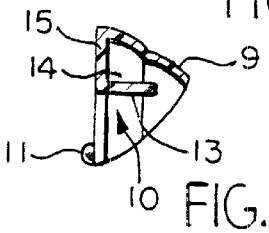
FIG. 6 is a cross-sectional view of the clip-on nictitating membrane taken through line 100—100 of FIG. 3.

FIG. 6 shows a cross-sectional view of the clip on artificial nictitating membrane 2, taken through a line 100—100 of FIG. 3, which shows the crescent shield 9, the clip 10, the post 13 of the clip 10, the supporting member 15 of the clip 10, along with the slot 14 formed by the post 13 and the support member 15.

Figure 4B:
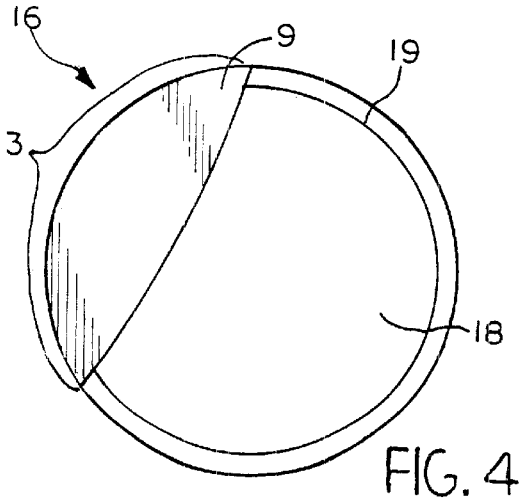
FIG. 4 is a full view in perspective of the bottom cap nictitating membrane which is mountable on the artificial eye blank on the bottom edge thereof.
Figure 4A:
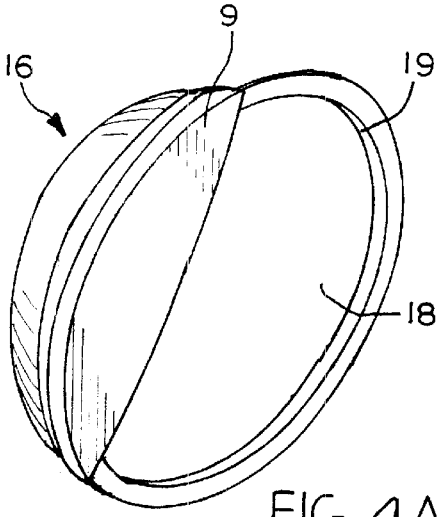

FIG. 4A is a full view in perspective of the bottom cap nictitating membrane configuration 16 which is mountable on the artificial eye on the bottom circumferential edge 8 thereof. FIG. 4B is a full top view of the bottom cap nictitating membrane configuration 16. The bottom cap nictitating membrane configuration 16 is configured in a low edge cap configuration wherein there is shown the nictitating membrane shield 9, the bottom of the cap 18, and the low lip 19. The low lip 19, in conjunction with the bottom 18 are configured such that the bottom cap nicitating membrane configuration 16 snaps onto the bottom circumferential edge 8 of the eye blank 1 such that the shield 9 lays on the outer convex surface 5 of the artificial eye blank 1. The bottom cup nictitating membrane configuration 16 is thus capable of rotating smoothly around the circumferential edge 8 of the eye blank I such that the nictitating membrane shield 9 can be located anywhere around the circumferential edge 8.

Figure 5A:
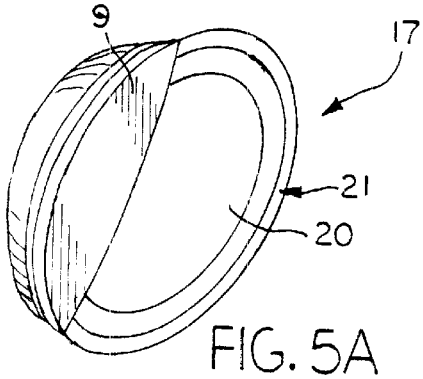
FIG. 5 is a full view in perspective of the ring configuration of the nictitating membrane which is mountable on the artificial eye blank on the bottom edge thereof.
Figure 5B:
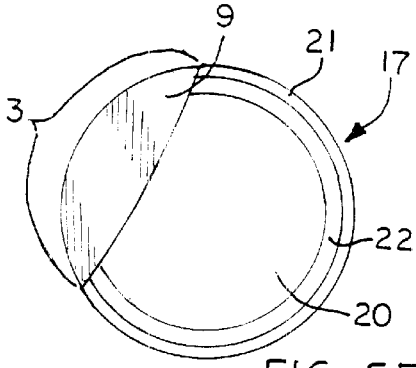

A further embodiment of the invention is that shown in FIG. 5A which is a full view in perspective of the ring configuration 17 of the nictitating membrane 2, which is mountable on the artificial eye blank 1 on the bottom circumferential edge 8 thereof.

Thus, there is shown the nictitating membrane configuration 17, with the shield 9, the opening 20 through the bottom thereof, the low lip 21, and the bottom of the ring 22 which is a narrow structure, such that the bottom of the ring 22 does not show through the transparent eye blank 1. The ring configuration 17 is thus capable of rotating smoothly around the circumferential edge 8 of the eye blank 1 such that the nictitating membrane shield 9 can be located anywhere around the circumferential edge 8.

It should be noted that the artificial eye blank can be colored by methods known to those skilled in the art, for example, by applying coloration to the convex outside surface, or applying coloration to the concave inner surface. The nictitating membrane 2 is dark colored, and is usually black or brown in color, dark brown being especially preferred. The artificial eye blank 1 can be formed out of various materials, such as glass, resins, elastomers, or plastics, and the nictitating membrane 2, and its attendant parts, can be formed out of glass, resins, elastomers, or plastics as well. Preferred is the manufacture of both the eye blank 1 and the nictitating membrane 2 out of plastic.

The transparent artificial eyepiece blank 1 and the nictitating membrane 2 can be formed by any convenient means for obtaining such components. For example, they can be extruded, molded, or cast, and the like, wherein it is very common in the art to hand cast such parts, especially using simple molding techniques such as plaster of paris mold forms.

Materials that are useful in such manufacture are plastics such as polyethylene, crosslinked polyethylene, and polypropylene because of the low cost, durability, and ease of manufacturing. Also preferred for such components are resins, such as, for example, epoxies, urethanes, and the like; elastomers, such as, for example, cureable silicones, and common rubbers; lattices that can be cured into parts, such as for example acrylics and methacrylics, polyvinyl alcohols and polyvinyl acetates, and the like. Most preferred for this invention is polypropylene for the nictitating membrane, and especially preferred is a dark brown colored polypropylene. Polyethylene, polypropylene and acrylic are preferred for the transparent artificial eye blank manufacture.

Now, eventhough this invention has been described particularly with the artificial deer eye in mind, it should be understood by those skilled in the art that artificial eyes for all sorts of uses can be made of eyes manufactured in this manner.

What is claimed is:

1. An artificial eye blank comprising:

a. a transparent artificial eyepiece segment having a concave inner surface and a convex outer surface and a bottom outside circumferential edge;

b. a moveable artificial nictitating membrane formed of a colorable material, said nictitating membrane slidably mounted on the bottom outside circumferential edge of the transparent artificial eyepiece segment.

2. An artificial eye comprising the transparent artificial eyepiece blank and nictitating membrane of claim 1 wherein there is additionally present on the concave inner surface of the transparent artificial eyepiece blank, eye coloration.

3. An artificial eye as claimed in claim 2 wherein the coloration is that of an animal eye.

4. An artificial eye as claimed in claim 3 wherein the coloration includes an animal eye texture pattern.

5. The artificial eye blank as claimed in claim 1 wherein the blank is manufactured from glass.

6. The artificial eye blank as claimed in claim 1 wherein the blank is manufactured from plastic.

7. The artificial eye blank as claimed in claim 6 wherein the plastic is polypropylene.

8. The artificial eye blank as claimed in claim 6 wherein the plastic is polyethylene.

9. The artificial eye blank as claimed in claim 1 wherein the blank is manufactured from a resin.

10. The artificial eyeblank as claimed in claim 9 wherein the resin is a cureable epoxy resin.

11. The artificial eyeblank as claimed in claim 9 wherein the resin is a thermoplastic resin.

12. The artificial eyeblank as claimed in claim 9 wherein the resin is a cureable urethane resin.

13. The artificial eyeblank as claimed in claim 9 wherein the resin is a cureable silicone resin.

14. The artificial eyeblank as claimed in claim 1 wherein the blank is manufactured from a polymer that is convertible to an elastomeric form.

15. The artificial eyeblank as claimed in claim 12 wherein the polymer is a cured urethane polymer.

16. The artificial eyeblank as claimed in claim 12 wherein the polymer is a cured silicone polymer.

17. The artificial eyeblank as claimed in claim 1 wherein the blank is manufactured from a latex that is convertible to a solid form.

18. The artificial eyeblank as claimed in claim 1 wherein the blank is manufactured from a cured elastomer.

19. The artificial eyeblank as claimed in claim 1 wherein the blank is manufactured by casting.

20. The artificial eyeblank as claimed in claim 17 wherein the blank is manufactured by hand casting.

21. The artificial eyeblank as claimed in claim 1 wherein the blank is manufactured by molding.

22. The artificial eyeblank as claimed in claim 1 wherein the blank is manufactured by extrusion molding.

23. The artificial eye blank as claimed in claim 1 wherein the nictitating membrane is manufactured from glass.

24. The artificial eye blank as claimed in claim 1 wherein the nictitating membrane is manufactured from plastic.

25. An artificial eye wherein the eye is comprised of:

a an artificial eyepiece blank having a concave inner surface and a convex outer surface and a bottom outside circumferential edge;

b. a moveable artificial nictitating membrane formed of a colorable material, said nictitating membrane slidably mounted on the bottom outside circumferential edge of the artificial eyepiece blank.

26. An artificial nictitating membrane wherein the artificial nictitating membrane is a clip-on element, which slidably mounts onto the bottom outside circumferential edge of the artificial eyepiece blank of claim 25.

27. An artificial nictitating membrane wherein the artificial nictitating membrane is comprised of a bottom cap and a shield, which bottom cap slidably mounts on the bottom outside circumferential edge of the artificial eyepiece blank of claim 25.

28. An artificial nictitating membrane wherein the artificial nictitating membrane is comprised of a ring and a shield, which ring slidably mounts on the bottom outside circumferential edge of the artificial eyepiece blank of claim 25.

* * * * *